US008757371B2

(12) United States Patent
Draghetti

(10) Patent No.: US 8,757,371 B2
(45) Date of Patent: Jun. 24, 2014

(54) PACKET FOR SMOKING ARTICLES AND RELATIVE CARDBOARD BLANK

(75) Inventor: Fiorenzo Draghetti, Medicina (IT)

(73) Assignee: GIMA S.p.A., Zola Predosa (BO) (IT)

( * ) Notice: Subject to any disclaimer, the term of this patent is extended or adjusted under 35 U.S.C. 154(b) by 25 days.

(21) Appl. No.: 13/575,557

(22) PCT Filed: Jan. 25, 2011

(86) PCT No.: PCT/IB2011/000105

§ 371 (c)(1),
(2), (4) Date: Jul. 26, 2012

(87) PCT Pub. No.: WO2011/092567

PCT Pub. Date: Aug. 4, 2011

(65) Prior Publication Data

US 2012/0292208 A1 Nov. 22, 2012

(30) Foreign Application Priority Data

Jan. 26, 2010 (IT) ..... MO2010A0013

(51) Int. Cl.
*B65D 85/10* (2006.01)
*B65D 5/38* (2006.01)
*B65D 43/16* (2006.01)

(52) U.S. Cl.
USPC ..... 206/270; 206/264; 206/268; 206/273; 229/125.125; 229/160.1

(58) Field of Classification Search
USPC ..... 206/264–268, 270, 271, 273; 229/125.5, 160.1
See application file for complete search history.

(56) References Cited

U.S. PATENT DOCUMENTS

| | | | | |
|---|---|---|---|---|
| 1,962,468 | A * | 6/1934 | Stein | 229/125.125 |
| 2,988,262 | A * | 6/1961 | Guyer et al. | 229/160.1 |
| 3,107,008 | A * | 10/1963 | Margulies | 206/267 |
| 4,586,605 | A * | 5/1986 | Newsome | 206/267 |
| 6,435,342 | B1 * | 8/2002 | Agnes | 206/268 |
| 7,320,399 | B2 * | 1/2008 | Ghini et al. | 206/268 |
| 7,658,280 | B2 * | 2/2010 | Bardet et al. | 206/267 |
| 8,042,685 | B2 * | 10/2011 | Bourgoin et al. | 206/267 |
| 8,196,749 | B2 * | 6/2012 | Chatelain | 206/767 |
| 8,281,922 | B2 * | 10/2012 | Chatelain | 206/267 |

FOREIGN PATENT DOCUMENTS

| | | |
|---|---|---|
| DE | 102006028130 | 12/2007 |
| EP | 2033900 | 3/2009 |
| GB | 1075618 | 7/1967 |
| WO | 2009/125240 | 10/2009 |
| WO | 2010/029383 | 3/2010 |

* cited by examiner

*Primary Examiner* — Bryon Gehman
(74) *Attorney, Agent, or Firm* — Hamre, Schumann, Mueller & Larson, P.C.

(57) ABSTRACT

A packet (1) for smoking articles comprises an external casing, including a containing body (3) and a lid (4) rotatable around a hinge (5) made on a wall of the external casing, and an internal casing (18), slidable with respect to the external casing. In order to provide an ample surface available for communications to the consumer, advertising messages or similar, the external casing comprises a further wall (17) joined to the internal casing (18) so as to be distanced from the containing body (3) when the internal casing (18) is at least partially extracted from the external casing.

13 Claims, 5 Drawing Sheets

PACKET FOR SMOKING ARTICLES AND RELATIVE CARDBOARD BLANK

The invention concerns a packet for smoking articles, particularly cigarettes, and a cardboard blank, from which it is possible to make the above mentioned packet.

Traditional cigarette packets have a rectangular parallelepiped shape which extends along a longitudinal axis and comprises a containing body and a lid hinged to the containing body by means of a hinge.

The containing body comprises a front wall, a rear wall, two lateral walls and a base wall, while the cover comprises a front face, a rear face, two lateral faces and an upper face, the above mentioned hinge being positioned between the rear wall of the containing body and the rear face of the lid.

The packets of the type described above are made starting from a roughed piece of rigid cardboard or blank. The blank has pre-weakened folding lines and is folded along these lines to form the packet.

Recently there has emerged a tendency to personalize these traditional packets with a hinged lid in order to induce smokers to prefer a packet having a certain aesthetic appearance rather than other more traditional packets.

Cigarette producers therefore find the need to modify the aesthetic appearance of the packet to make it more distinctive or more attractive for the consumer.

For this reason, packets have been made in which an external casing is provided, including a containing body and a hinged lid, and an internal casing, housing a composition of cigarettes, the internal casing being sliding with respect to the containing body and the lid. A packet of this type is described in the patent DE102006028130.

In particular, in the packet indicated in DE102006028130 the containing body is provided with an aperture, made in a lower portion of the front wall and in a central portion of the base wall, so as to allow access to the internal casing, in particular to a base side of the latter. Moreover, in the packet described in DE102006028130 the lid is connected to the inside casing by means of a flap extending from a front side, facing the front wall of the containing body of the internal casing.

During use, a consumer inserts a finger into the above mentioned aperture and acting on the base side, pushes the internal casing toward the outside of the containing body. Following this movement, the flap, connected to the lid, rotates the latter into an open position. After having removed the cigarette, in order to close the packet, the consumer pushes the internal casing toward the inside of the containing body until the base side meets the base wall. Following this movement, the flap, connected to the lid, rotates the latter into a closed position.

One defect of packets of the type described in DE102006028130 is the small space available for personalizing the packets, for example using writings, drawings or more general advertising messages printed on the visible surfaces of the packet. Such messages can be printed, as well as on the external casing, as already happens in traditional packets, only on a reduced end portion of a rear side, opposite the front side, of the internal casing, emerging, in an opened configuration of the packet, from the containing body. However, the length of the flap, connecting the internal casing to the lid, greatly limits the end portion of the rear side visible in the open configuration of the packet.

Moreover, although the packets having a sliding internal casing have been appreciated by young or imaginative smokers, more conservative smokers have shown a certain aversion for the packets described above and for the complicated opening system which they entail.

One purpose of the present invention is to improve packets for smoking articles, particularly for cigarettes, and the relative cardboard blanks which can be used to make these packets.

Another purpose is to supply packets for smoking articles, particularly for cigarettes, which have an ample surface available for communications to the consumer, advertising messages or similar.

A further purpose is to provide packets for smoking articles, particularly for cigarettes, which are versatile, so as to be appreciated both by smokers with more conservative tastes and for smokers who appreciate innovative configurations.

In a first feature of the invention a packet for smoking articles, particularly for cigarettes, is provided, as described in the independent claim 1.

The packet according to the first feature of the invention renders a very ample surface available on which advertising messages and other communications for the consumer can be printed.

The information can be printed both on the external casing and on an extended portion of the internal casing, which becomes visible when the latter is partially extracted from the external casing.

In particular, since the lid is not connected to the internal casing, as described instead in DE102006028130, it is possible to increase the extension of this portion, compared to known packets, thus allowing to increase a surface available for communications to the consumer, such as advertising messages or similar.

Moreover the packet according to the first feature of the invention is particularly versatile, since it can be used like a traditional packet, if the internal casing is not extracted from the external casing, or like a packet of the non standard type, if the internal casing is at least partially extracted from the external casing.

In this way, the packet according to the first feature of the invention can be appreciated both by more conservative smokers and by more imaginative smokers.

In a second feature of the invention a cardboard blank is provided, as described in the independent claim 16.

The blank cardboard provided in the second feature of the invention allows to easily produce the packet according to the first feature of the invention even on traditional machines, since the blank has an external contour similar to that of traditional blanks.

In particular, the intended breakage line provided on the blank, if fractured, allows to distance the part of the further wall from the containing body when the internal casing is at least partially extracted from the external casing.

The invention can be understood and implemented better with reference to the attached drawings, which show a non-restrictive example wherein:

FIGS. 1 and 2 show a packet 1 for smoking articles, in particular cigarettes, which are not shown.

Figure 1:
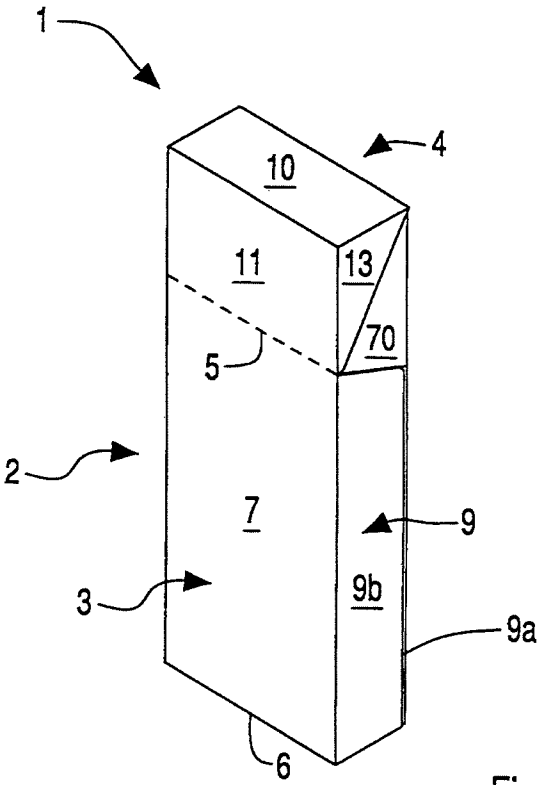
FIG. 1 is a front perspective view of a packet for smoking articles according to the invention, in a closed configuration.

The packet 1, which is of the rigid type, comprises an external casing 2 of a substantially parallelepiped shape. The external casing 2 comprises a containing body 3, which can house the cigarettes, and a lid which can be opened or closed in order to allow a consumer to access the cigarettes. In particular, the lid 4 is mobile between an open position and a closed position, rotating around a hinge 5, shown in FIG. 1.

The containing body 3 comprises a base wall 6, from which a front wall 7 and a rear wall 8 opposite the front wall develop. Between the front wall 7 and the rear wall 8 two lateral walls 9 are interposed, each of which has a reduced extension with respect to the front wall 7 and the rear wall 8.

In particular, each lateral wall 9 is formed by a first lateral wall 9*a* developing from the rear wall 8 and by a second lateral wall 9*b* developing from the front wall 7, each lateral wall 9*b* being external with respect to, and substantially overlapping for the entire thickness of the corresponding first lateral wall 9*a*.

The containing body 3 also comprises an anchoring panel 17, the function of which will be clarified in hereafter, adjacent and less extended with respect to the rear wall 8.

Two more lateral panels 70 develop laterally from the anchoring panel 17, substantially coplanar with the respective first lateral walls 9*a*.

An upper wall 72 (FIGS. 3 and 4), which in the closed position is opposite the base wall 6, also develops from the anchoring panel 17.

Figure 4:
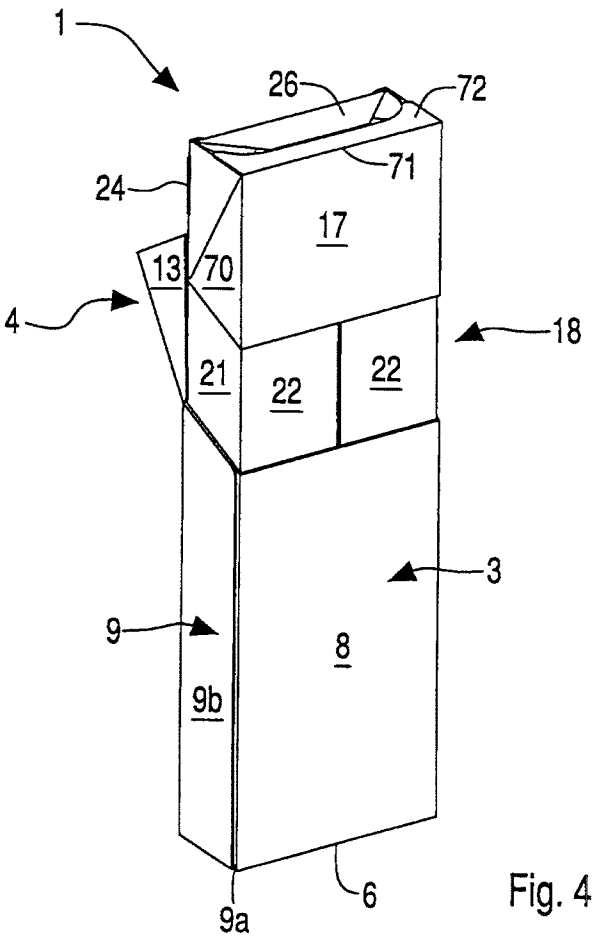
FIG. 4 is a rear perspective view of the packet in FIG. 3.
Figure 3:
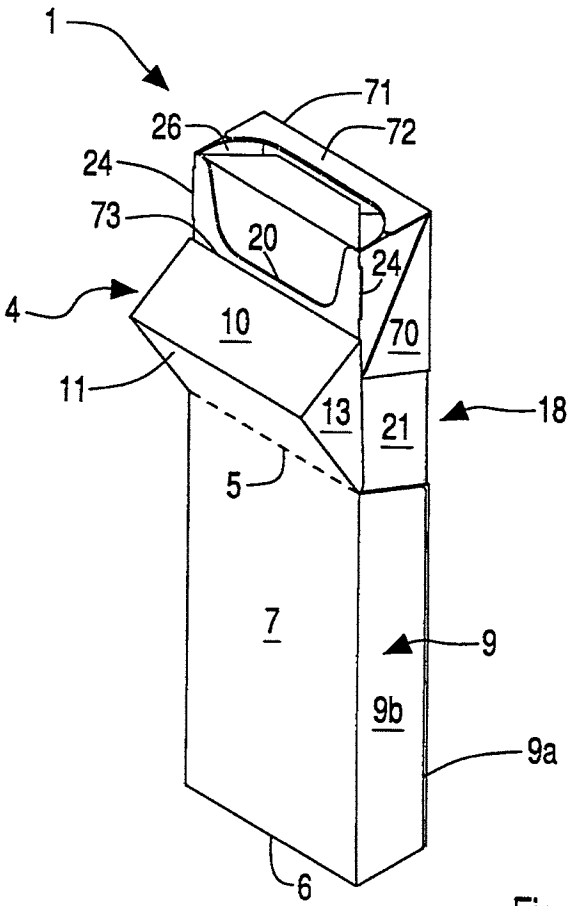
FIG. 3 is a front perspective view like that in FIG. 1, showing the packet in an open configuration.

Between the upper wall 72 and the anchoring panel 17 an upper edge 71 of the external casing 2 is defined (FIGS. 3 and 4).

The external casing 2 has an intended breakage line 14 interposed between the anchoring panel 17 and the rear wall 8. The intended breakage line 14 can be formed by a plurality of cuts 15 mutually separated by joining portions 16. In some forms of embodiment the intended breakage line 14 can be pre-cut.

In the example shown here, the intended breakage line 14 has a substantially rectilinear shape, but it is possible to use different shapes, for example a semi-circumference like a "V", a "U", oval or polygonal.

The lid 4 comprises an upper face 10, which in the closed position is opposite the base wall 6.

A front face 11 is connected to the upper face 10. Two lateral faces 13, of a substantially triangular shape, develop from the upper face 10. When the packet 1 is in the closed position shown in FIGS. 1 and 2, the front face 11 of the lid 4 is contiguous and coplanar to the front wall 7 of the containing body 3. Moreover, in this position, the upper face 10 is opposite and parallel to the base wall 6 of the containing body 3, and faces the upper wall 72, an edge 73 of the upper face 10 facing the upper edge 71.

Still in this configuration, the lateral faces, substantially coplanar to the second lateral walls 9*b*, at least partially overlap a respective further lateral wall 70 of the containing body 3.

Finally, in the closed position, the anchoring panel 17 is flush with the rear wall 8.

The anchoring panel 17 and the rear wall 8 of the containing body 3 define an external wall of the packet 1 on which the intended breakage line 14 is made.

Vice versa, the front face 11 of the lid 4 and the front wall 7 of the containing body 3 define a further external wall of the packet 1 on which the hinge 5 is made. The material of which the external casing 2 is made can be cardboard, and can be broken along the intended breakage line 14 in order to separate the anchoring panel 17 from the containing body 3, as will be explained more fully hereafter.

Figure 6:
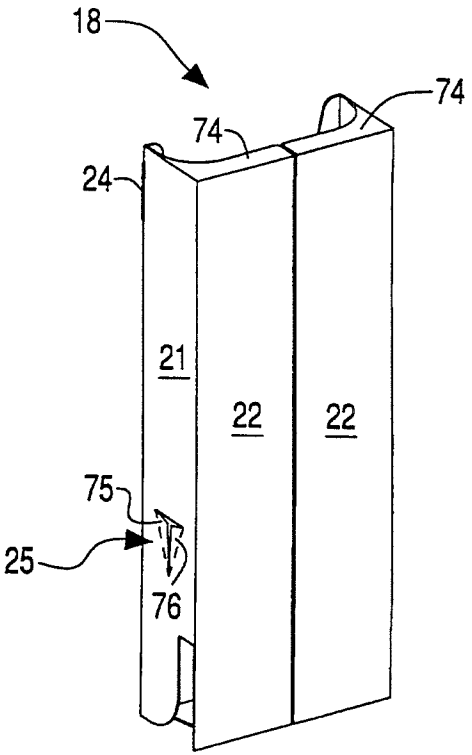
FIG. 6 is a perspective view showing a rear portion of the internal casing in FIG. 5.
Figure 7:
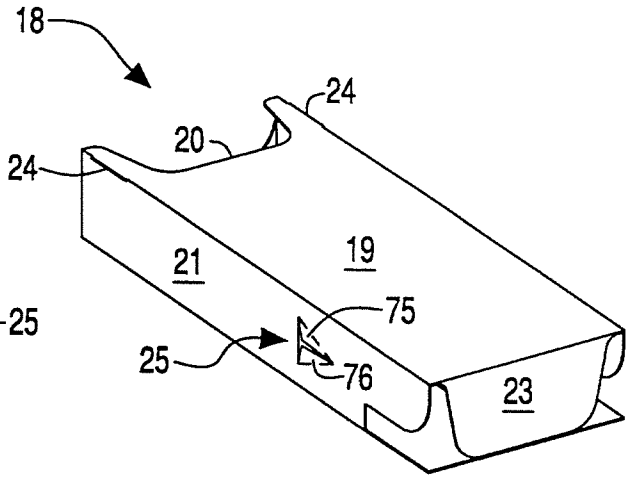
FIG. 7 is a further perspective view showing a lower portion of the internal casing in FIG. 5.
Figure 5:
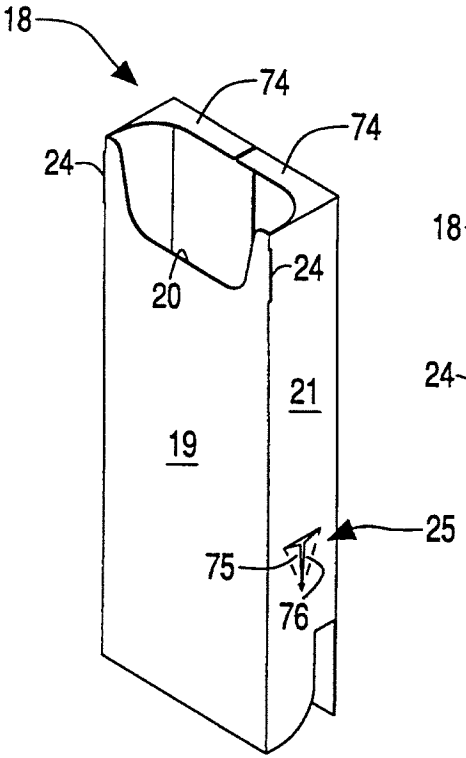
FIG. 5 is a perspective view of an internal casing of the packet in FIG. 1.

An internal casing 18 is positioned inside the outer casing 2, shown in detail in FIGS. 5 to 7. The internal casing 18 houses an internal wrapper 26 comprising a composition of cigarettes wrapped in silver foil (FIGS. 3 and 4). The internal wrapper 26 is of the known type and does not have any substantial differences with respect to the internal wrappers used in normal cigarette packets.

The internal casing 18 comprises a main wall 19 delimited by a U-shaped upper contour 20. Two minor walls 21 are connected to the main walls 19.

The internal casing 18 also comprises a pair of upper flaps 74, each of which is connected to a respective minor wall 21. In particular, the upper flaps 74 are folded above the internal wrapper 26 so as to be adjacent with respect to each other so as to contain the internal wrapper 26 at the upper part.

From each of the minor walls 21 a secondary wall 22 also develops. The minor walls 21 laterally contain the internal wrapper 26 so as to be adjacent with respect to each other and to contain the internal wrapper 26 at the rear. The internal casing 18 also comprises a lower flap 23 (FIG. 7), connected to the main wall 19 and delimited by a complementary perimeter with respect to the upper contour 20.

The lower flap 23 is folded below the internal wrapper 26 and contains the internal wrapper 26 at the bottom.

Two closing fins 24 project toward the outside from the main wall 19, in proximity to the upper contour 20, and are able to engage with the lid 4 in order to keep it in a closed position.

In a lower region of the minor walls 21 stopping means 25 are also made, which can engage with further stopping means, not shown, made in the first lateral walls 9*a* and projecting toward the inside of the external casing 2 to impede the internal casing 18 from exiting completely from the external casing 2, when the packet 1 is being used.

In particular, the stopping means 25 have the shape of an arrow head and each comprise respectively a first fin 75 and a second fin 76 mutually separated and folded toward the outside of the internal casing 18 in correspondence with the sides of greater length.

The further stopping means, rotated by 180° with respect to stopping means 25, are structurally and functionally similar to the latter.

In particular, the further stopping means also have an arrow head shape and each comprise respectively another first fin and another second fin, mutually separated and folded toward the inside of the external casing 2 in correspondence with further sides of greater length.

When in use, the first fin 75 and the second fin 76 abut, by means of their sides of lesser length, with respective further sides of lesser length of the further first fin and the further second fin so as to impede the internal casing 18 from exiting completely from the external casing 2.

On the main wall 19, on the minor walls 21 and on the secondary walls 22 printed zones are provided, not shown, comprising for example writings, drawings or other information intended for the consumer.

The internal casing 18 is disposed inside the external casing 2 and is attached to the external casing 2 in correspondence with the anchoring panel 17.

In particular, on the internal surface of the anchoring panel 17 one or more gluing points are applied by means of which the anchoring panel 17 sticks to both the secondary walls 22.

In one version of the invention, not shown, the anchoring panel 17 is joined to only one of the secondary walls 22.

Similarly, on the internal surface of the further lateral panels 70 one or more gluing points can be applied by means of which the further lateral walls 70 can each be stuck to a minor wall 21.

This allows to keep the internal casing 18 closed around the internal wrapper 26 and above all to attach the anchoring panel 17 to the internal casing 18.

The packet 1 can be used as a normal cigarette packet, if the internal casing 18 is not extracted from the external casing 2.

In this case, the consumer can open the packet 1 by rotating the lid 4 around the hinge 5, removing the cigarette and then re-closing the lid 4, as happens in traditional packets.

The anchoring panel 17 can also be separated from the containing body 3 by acting on the intended breakage line 14.

In particular, after having positioned the lid 4 in an open position, the consumer can grasp with one hand the further lateral walls 70 and the containing body 3 with the other hand and apply to the anchoring panel 17 and to the rear wall 8 of the containing body 3 a force which tends to separate the anchoring panel 17 from the containing body 3.

In this way the joining portions 16 break and the anchoring panel 17 stays attached to the internal casing 18, but separates from the containing body 3. The consumer can then partially extract from the external casing 2 the internal casing 18, to which the anchoring panel 17 is attached, as shown in FIGS. 3 and 4.

When this happens, the anchoring panel 17 is distanced from the containing body 3, in particular from the rear wall 8.

The stopping means 25 made on the internal casing 18 impede the internal casing from being completely extracted from the external casing 2, abutting against the further stopping means of the external casing 2.

After having at least partially extracted the internal casing 18 from the external casing 2, the consumer can access the cigarettes.

It should be noted that, when the internal casing 18 is extracted from the external casing 2, the printed zones are visible by the consumer, who can therefore read the writings and look at the drawings contained in the printed zones.

This allows to personalize the packet and to increase the space available for communications for the consumer.

Indeed, the communications for the consumer and the possible publicity messages can now be printed not only on the external surface of the containing body 3 and the lid 4, but also in the printed zones of the internal casing 18.

After having removed the cigarette, the consumer can slide the internal casing 18 until the base wall 6 abuts with the lower flap 23, in order to reposition it inside the external casing 2 and close the lid 4, so that the packet 1 once again assumes the shape of a traditional rigid packet.

Naturally, even after having detached the anchoring panel 17 from the containing body 3, the consumer can still use the packet 1 as a traditional packet, that is, he can access the cigarettes by rotating the lid 4 around the hinge 5, without extracting the internal casing 18 from the external casing 2.

Figure 8:
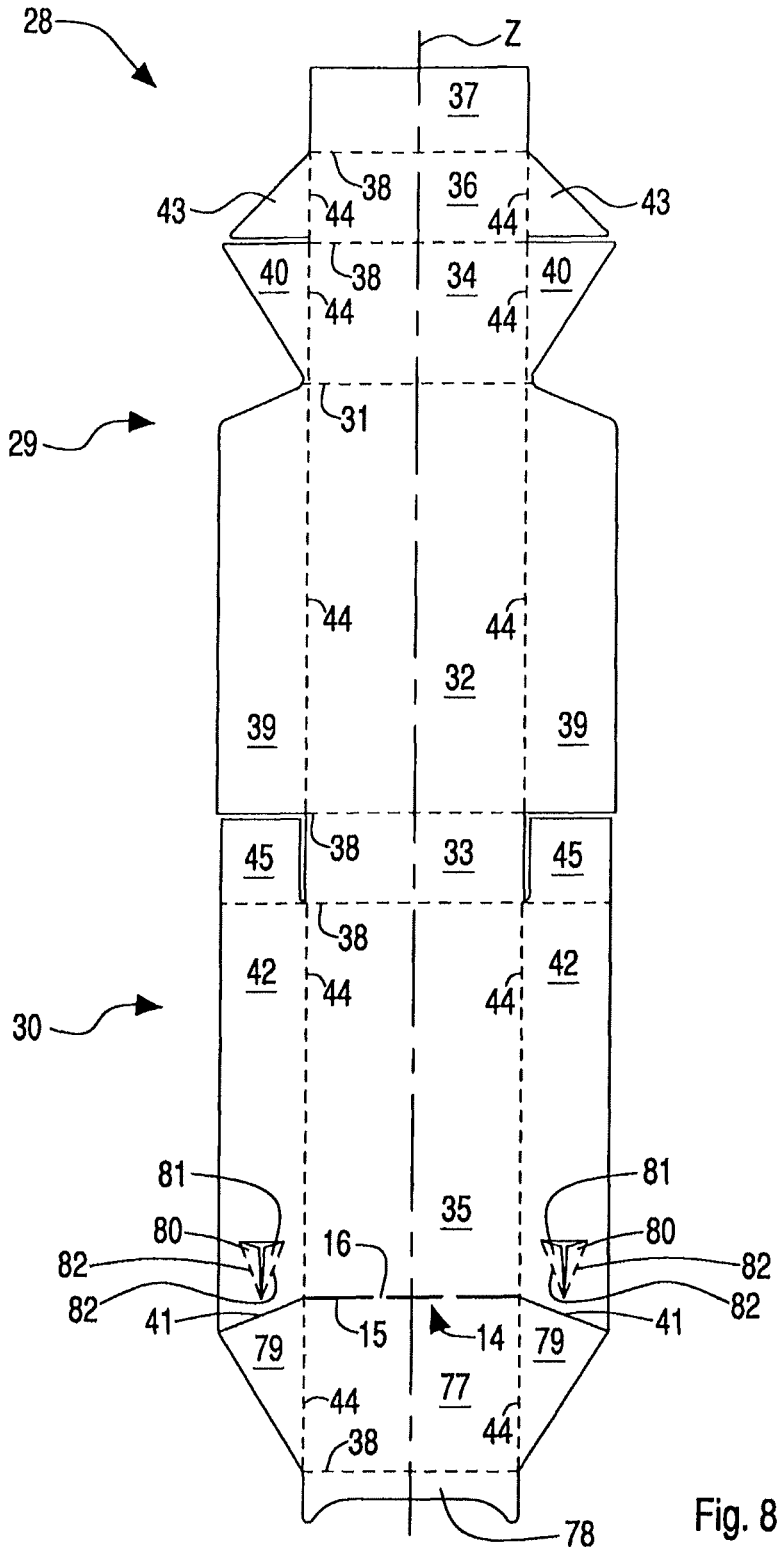
FIG. 8 is a plane view of a cardboard blank used to make the packet in FIG. 1.

The external casing 2 is formed by folding a blank 28 of the type shown in FIG. 8, made of cardboard for example.

The blank 28 comprises a first portion 29, destined to form the lid 4, the front wall 7 and the second lateral walls **9*b*, and a second portion 30, destined to form the rear wall 8, the anchoring panel 17, the base wall 6, the first two lateral walls 9*a*, the further lateral walls 70 and the upper wall 72**.

The blank 28 also comprises an intended breakage line 31, destined to give rise to the hinge 5 in the packet 1.

The intended breakage line 31 can comprise a pre-creasing or be formed by a plurality of cuts separated by joining points.

The intended breakage line 31 is made inside a main panel 32 of the blank 28, the main panel 32 being destined to form, in the external casing 2, the front wall 7 of the containing body 3.

The blank 28 extends along a longitudinal axis Z, which can be an axis of symmetry.

A first transverse panel 33 and a second transverse panel 34 are disposed at opposite ends of the main panel 32, so that the first transverse panel 33, the main panel 32 and the second transverse panel 34 are disposed in sequence along the longitudinal axis Z.

The first transverse panel 33 is intended to form the base wall 6 of the packet 1, while the second transverse panel 34 is intended to form the front face 11 of the lid 4.

A bigger panel 35 is connected to the first transverse panel 33, destined to form the rear wall 8 of the containing body 3, while a smaller panel 36, which will form the upper face 10 of the lid 4, is connected to the second transverse panel 34.

The smaller panel 36 is in turn connected to a block 37, disposed to be folded by 180° so as to reinforce an upper portion of the lid 4.

The bigger panel 35 is in turn connected to a third transverse panel 77, destined to form the anchoring panel 17.

Figure 2:
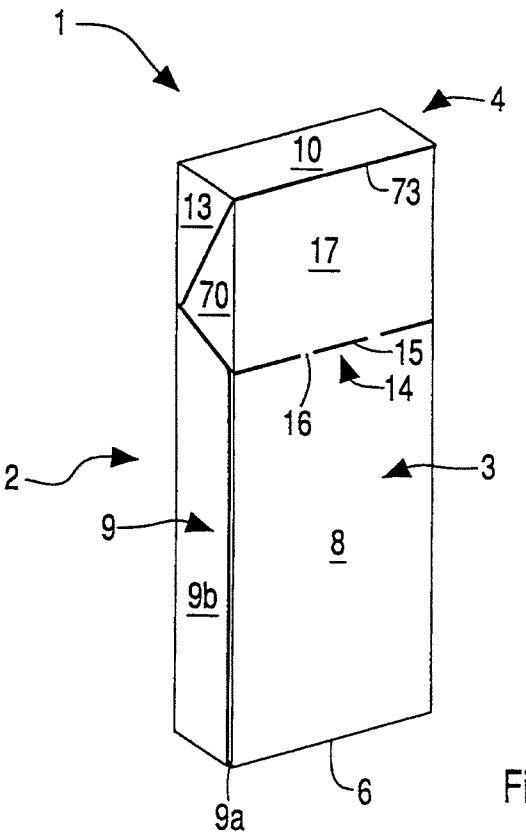
FIG. 2 is a rear perspective view of the packet in FIG. 1.

In particular, the bigger panel 35 and the third transverse panel 77 are joined with respect to each other along the intended breakage line 14, already described with reference to FIG. 2, which can be defined by the cuts 15 alternating with joining portions 16. As has already been described, in some forms of embodiment the intended breakage line 14 can be pre-cut.

As has already been explained with reference to the external casing 2, the intended breakage line 14 can be of a rectilinear or semi-circular shape, but can also have other geometrical shapes.

If the cardboard which forms the blank 28 is hypothetically torn along the intended breakage line 14, the blank 28 would be divided into two parts.

Furthermore, the third transverse panel 77 is in turn connected to a fourth transverse panel 78, destined to form the upper wall 72.

The fourth transverse panel 78 and the third transverse panel 77, the bigger panel 35 and the first transverse panel 33, the first transverse panel 33 and the main panel 32, the second transverse panel 34 and the smaller transverse panel 36, and the smaller transverse panel 36 and the block 37 are joined along respective transverse pre-creasings 38, disposed transversely, in particular perpendicularly, to the longitudinal axis Z.

The blank 28 also comprises a pair of first external panels 39, disposed at the two sides of the main panel 32 in a region defined between the intended folding line 31 and the first transverse panel 33, destined to form the second lateral walls **9*b***.

A pair of second external panels 40 is also provided, disposed at the two sides of the second transverse panel 32 in a region defined between the intended folding line 31 and the smaller panel 36, destined to form the lateral faces 13 of the lid 4.

Two first internal panels 42 are disposed at the sides of the bigger panel 35, and are destined to form the first lateral walls 9*a*, while two second internal panels 43 are disposed at the sides of the smaller panel 36.

When the blank 28 is folded to form the external casing 2, each first external panel 39 overlaps a first internal panel 42 to form the lateral walls 9 of the containing body 3.

Similarly, each second external panel 40 overlaps a corresponding second internal panel 43 to form the lateral faces 13 of the lid 4. A pair of third external panels 79 is also provided, disposed at the two sides of the third transverse panel 77 in a region defined between the intended breakage line 14 and the fourth transverse panel 78, and destined to form the further lateral walls 70.

Each first internal panel 42 is separated from the corresponding third external panel 79 by means of an inclined cut 41.

The internal panels 42, 43 and the external panels 39, 40 and 79 are connected respectively to the bigger panel 35, the smaller panel 36, the main panel 32 and the second transverse panel 34 and the third transverse panel 77 along longitudinal pre-creasings 44, substantially parallel to the longitudinal axis Z.

Fins 45 are connected to the ends of the first internal panels 42 opposite the inclined cuts 41, and are disposed to be folded back inside the first transverse panel 33 so as to stiffen the base wall 6 of the external casing 2.

On each first internal panel 42, in proximity to the inclined cuts 41, a first and a second jutting element 80, 81 are made, which act as further stopping means in order to cooperate with the stopping means 25 of the internal casing 18, so as to impede the internal casing 18 from exiting completely from the external casing 2.

The first and second jutting elements 80, 81 are separated from each other and suitably previously folded toward the outside of the blank 28 around respective inclined pre-creasings 82.

In this way, in the finished packet 1, the first and the second jutting elements 80, 81 project toward the inside of the external casing 2.

When the blank 28 is processed on the packing machine 20, an adhesive substance is applied on the internal surface of the blank 28 in correspondence with the first external panels 39 and the second external panels 40, so as to allow said panels to stick to the corresponding internal panels 42, 43.

The adhesive substance is also applied on the internal surface of the third transverse panel 77, of the third external panels 79 and of the fourth transverse panel 78, to allow said panels to be attached to the internal casing 18.

Furthermore, the adhesive substance is also applied to the first transverse panel 33 to allow the fins 45 to be attached to the latter.

After having received the adhesive substance, the blank 28 is folded according to the traditional sequence of folding operations, given that the blank does not have added panels compared to traditional blanks. Therefore, the blank 28 can be processed in a common machine for the production of rigid cigarette packets.

Figure 9:
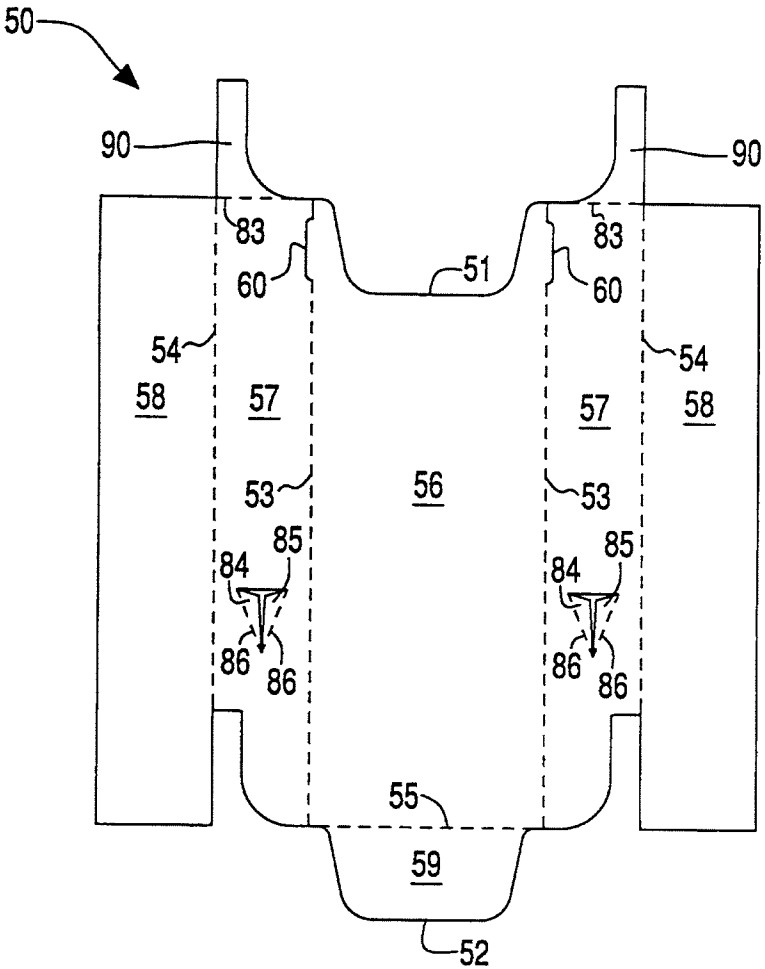
FIG. 9 is a plane view of an inner containing element, or collar, in order to obtain the internal casing in FIG. 5.

FIG. 9 shows an inner containing element, or collar, 50 which can be used to form the internal casing 18. The collar 50 can be made of cardboard, possibly coupled to a sheet of metal, such as aluminum. The collar 50 can be shaped directly on the packing machine starting from a coil, which is cut with a knife having a profile corresponding to an upper transverse profile 51 and to a lower transverse profile 52 of the collar 50.

Two internal weakening lines 53 and two external weakening lines 54 are also made on the collar 50 by means of suitable cutters. The external weakening lines 54 are disposed outside the internal weakening lines 53. One transverse weakening line 55, disposed transversely with respect to the internal and external weakening lines 53 and 54, is made in a lower region 20 of the collar 50. Finally, a further transverse weakening line 83, disposed transversely with respect to the internal and external weakening lines 53 and 54, is made in an upper region of the collar 50.

Between the internal weakening lines 53 and the transverse weakening line 55 a primary panel 56 is defined, disposed to form the main wall 19 in the internal casing 18.

Two lateral panels 57 are disposed at the sides of the primary panel 56, each of which is interposed between an internal weakening line 53 and an external weakening line 54. Each lateral panel 57 is destined to form a minor wall 21 of the internal casing 18.

Furthermore, two peripheral panels 58 are provided outside the lateral panels 57, each of which is joined to a corresponding lateral panel 57 along an external weakening line 54. The peripheral panels 58 are folded back behind the internal wrapper 26 to form the secondary walls 22.

In this way, after having been folded back, the collar 50 surrounds the internal casing 18 on four sides.

Between the transverse weakening line 55 and the lower transverse profile 52, an end panel 59 is defined, able to be folded back below the internal wrapper 26 in order to obtain the lower flap 23.

In this way, after having been folded back, the collar 50 surrounds the internal casing 18 on five sides.

Furthermore, between the further transverse weakening line 83 and the upper transverse profile 51 further end panels 90 are defined, able to be folded back above the internal wrapper 26 in order to form the upper flaps 74.

It should be noted that the upper flaps 74 are destined to be glued to the fourth transverse panel 78 in order to stiffen it.

In this way, after having been folded back, the collar 50 surrounds the internal casing 18 on six sides.

Two C-shaped cuts 60 are made on the collar 50, destined to form the closing fins 24.

A further first and a further second jutting element 84, 85 are also made on each lateral panel 57, destined to form the first fin 75 and the second fin 76 of the stopping means 25.

The further first and the further second jutting elements 84, 85 are separated from each other and suitably previously folded toward the outside of the collar 50 around respective inclined pre-creasings 86.

In this way, in the finished packet 1, the further first and the further second jutting element 84, 85 project toward the outside of the internal casing 18. During the packaging, the collar 50 is folded around the internal wrapper 26 and made adherent to it by means of gluing points positioned in a substantially similar manner to that of traditional collars.

The collar 50 can be folded around the internal wrapper 26 using a folding unit similar to that used for traditional collars.

The external casing 2 is then made by folding the blank 28 around the internal casing 18.

From the above description it is obvious that the packet 1 can be made using packing machines which are not substantially different from existing machines.

In one version of the invention, not shown, the packet can be completed by applying a stamp in a connection zone between the anchoring panel 17 and the rear wall 8. In particular the stamp can partially cover the anchoring panel 17. In this case, an intended separation line is made on the stamp, having the same profile as the intended breakage line 14.

By doing so, when the anchoring panel 17 is detached from the containing body 3, the stamp also breaks into two parts, one of which remains attached to the anchoring panel, while the second remains attached to the containing body.

In the drawings shown, only packets of a parallelepiped shape having longitudinal edges shaped at right angles have been shown.

However, the packet according to the invention can also comprise one or more beveled edges, longitudinal or transverse, or one or more rounded edges, longitudinal or transverse.

In particular, the packet according to the invention can have the shape of an octagonal packet or of a so-called round-corner packet.

In one version of the invention, not shown, the intended breakage line 14 can be fractured on the packing machine, after having formed the external casing 2.

In this version, therefore, instead of the breakage line 14, the packet 1 comprises a cutting line or cut, separating the anchoring panel 17 from the containing body 3.

After the cut line has been made, a transparent film is wrapped around the external casing 2 and then welded, as happens in traditional packets.

In this way, when the consumer breaks the transparent film in order to access the external casing 2, the anchoring panel 17 is already separated from the containing body 3 and the consumer, if he wants to extract the internal casing 18, does not have to fracture the intended breakage line 14 but, if the stamp is there, only the separation line.

The invention claimed is:

1. A packet for smoking articles, comprising an external casing, including a containing body and a lid rotatable around a hinge made on a wall of said external casing, and an internal casing slidable with respect to said external casing, said external casing comprising a further wall joined to said internal casing and detachable from said external casing so as to be distanced from said containing body when said internal casing is at least partially extracted from said external casing, said external casing further comprising lateral walls being provided on opposite sides of said further wall and connected to corresponding further lateral walls of said internal casing, said lateral walls being distanced from said containing body and said lateral walls remaining integral with said internal casing when said internal casing is at least partially extracted from said external casing, and one of an intended breakage line interposed between said further wall and said containing body, said intended breakage line being able to be broken to separate said further wall from said containing body, and a cutting line interposed between said further wall and said containing body, said cutting line being able to be cut to separate said further wall from said containing body, wherein an internal surface of each of said lateral walls includes a gluing point to adhere each of said lateral walls to the corresponding further lateral wall of said internal casing so as to keep said internal casing closed around an internal wrapping comprising a composition of smoking articles, and so as to attach said further wall to said internal casing.

2. The packet as in claim 1, comprising an upper wall connected to said further wall and opposite a base wall of said external casing, said upper wall being connected to at least an upper flap of said internal casing and being distanced from said containing body when said internal casing is at least partially extracted from said external casing.

3. The packet as in claim 2, wherein the lid comprises an upper face which, in the closed position, is opposite the base wall, a front face being connected to the upper face and two lateral faces developing from the upper face, wherein, when the lid is in the closed position, the front face of the lid is contiguous and coplanar to the external front wall of the containing body, the upper face is opposite and parallel to the base wall of the containing body, and faces the upper wall, an edge of the upper face facing the upper edge and the lateral faces, substantially coplanar to the second lateral walls, at least partially overlap a respective further lateral wall of the containing body and said further wall is flush with the rear wall.

4. The packet as in claim 1, wherein said wall on which said hinge is made is a front external wall of said external casing and said further wall is a rear external wall of said external casing.

5. The packet as in claim 4, wherein between said front external wall and the rear wall, two lateral walls are interposed, each of which has an extension reduced with respect to the front external wall and the rear wall, each lateral wall being formed by a first lateral wall developing from the rear wall and by a second lateral wall developing from the front external wall, each lateral wall being external with respect to, and overlapping substantially for the whole thickness of, the corresponding first lateral wall, wherein said lateral walls are substantially coplanar to the respective first lateral walls.

6. The packet as in claim 1, wherein said further wall is joined to at least a rear wall of said internal casing.

7. The packet as in claim 6, wherein said rear wall includes a secondary wall of said internal casing, said secondary wall being disposed to be folded behind a composition of smoking articles.

8. The packet as in claim 1, wherein said further wall comprises an anchoring panel with an inside surface to which an adhesive substance can be applied.

9. The packet as in claim 1, wherein said one of said intended breakage line and said cutting line, has a substantially rectilinear development.

10. The packet as in claim 1, wherein said intended breakage line comprises a plurality of joining portions mutually separated by cuts, and wherein said cutting line comprises a cut.

11. The packet as in claim 1, wherein said one of said intended breakage line and said cutting line, is made between said further wall and a rear wall of said external casing.

12. The packet as in claim 10, wherein said lateral walls are suitable to act as a grip portion in order to apply a force at least to said further wall of the containing body in order to separate said further wall from the containing body so as to determine the breakage of the joining portions and the separation of said further wall from the containing body, said wall remaining attached to the internal casing and distanced from the rear wall of the containing body.

13. The packet as in claim 1, wherein said internal casing comprises stoppers cooperating with further stoppers of said external casing to prevent said internal casing from being extracted completely from said external casing.

* * * * *